US006514127B2

(12) United States Patent
Huang et al.

(10) Patent No.: US 6,514,127 B2
(45) Date of Patent: Feb. 4, 2003

(54) CONDITIONER SET FOR CHEMICAL-MECHANICAL POLISHING STATION

(75) Inventors: Chi-Ming Huang, Hsinchu Hsien (TW); Shuang-Neng Peng, Taipei Hsien (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 53 days.

(21) Appl. No.: 09/726,467

(22) Filed: Nov. 30, 2000

(65) Prior Publication Data

US 2002/0065029 A1 May 30, 2002

(51) Int. Cl.[7] ..... B24B 7/00
(52) U.S. Cl. ..... 451/72; 451/56
(58) Field of Search ..... 451/21, 56, 72, 451/443, 444

(56) References Cited

U.S. PATENT DOCUMENTS 5,626,509 A * 5/1997 Hayashi ..... 451/271
5,775,983 A * 7/1998 Shendon et al. ..... 451/285
5,902,173 A * 5/1999 Tanaka ..... 451/287
5,990,010 A * 11/1999 Berman ..... 438/691
6,135,868 A * 10/2000 Brown et al. ..... 451/443
6,196,899 B1 * 3/2001 Chopra et al. ..... 451/285

* cited by examiner

*Primary Examiner*—Timothy V. Eley
*Assistant Examiner*—Alvin J. Grant
(74) *Attorney, Agent, or Firm*—J.C. Patents

(57) ABSTRACT

A multi-functional conditioner set for a chemical-mechanical polishing station. The multi-functional conditioner set has at least two conditioning heads each made from a different material such as diamond dust and nylon. The multi-functional conditioner set also includes an ejection tube for delivering chemical agents and de-ionized water to the conditioning heads. Moreover, a vibrator is attached to the ejection tube to transmit ultrasonic or megasonic vibration to the chemical agents and de-ionized water. The conditioning heads can be arranged in various combinations and the ejection tube set to various control settings. Hence, a polishing pad can be cleaned or reconditioned and residual diamond particles on the polishing pad can be removed. Furthermore, the conditioner set occupies only a single area above the polishing table of the polishing station.

10 Claims, 4 Drawing Sheets

CONDITIONER SET FOR CHEMICAL-MECHANICAL POLISHING STATION

BACKGROUND OF THE INVENTION

1. Field of Invention

The present invention relates to equipment for manufacturing semiconductors. More particularly, the present invention relates to a multi-functional conditioner set for a chemical-mechanical polishing station.

2. Description of Related Art

Chemical-mechanical polishing is one of the most important techniques for global planarization of very-large scale integration (VLSI) and ultra-large scale integration (ULSI) circuits.

FIGS. 1A and 1B are respective top and side views of a conventional chemical-mechanical polishing station. As shown in FIGS. 1A and 1B, a chemical-mechanical polishing station includes a polishing table 10, a holder 11, a polishing pad 13, a delivery tube 14, a pump 16 and a conditioner 17. The holder 11 is used for gripping a silicon chip 12 to be polished. The polishing pad 13 is a layer of polishing material over the polishing table 10. The delivery tube 14 is used to deliver slurry 15 to the polishing pad 13. The pump 16 pumps slurry 15 from a slurry container to the delivery tube 14. The conditioner 17 serves to roughen the surface of polishing pad 13, to remove any residual slurry and to clean. To conduct chemical-mechanical polishing, both the polishing table 10 and the holder 11 rotate in a pre-defined direction shown by arrows 18*a* and 18*b*. The holder 11 grips the backside 19 of the silicon chip 12 so that the front side 20 of the chip 12 is pressed onto the polishing pad 13. The pump 16 drives slurry 15 through the delivery tube 14 so that the polishing pad 13 receives a stable supply of slurry 15. Since any protruding portions on silicon chip surface 20 are in contact with the polishing pad 13, the protruding portions are removed with the assistance of chemical agents and abrasive particles in the slurry 15. Hence, a planarized surface is obtained after repeated chemical and mechanical polishing actions.

In general, a polishing pad has tiny holes for assisting the polishing process and the transmission of slurry. In addition, the polishing pad has a roughened surface whose height varies between 1 to 2 $\mu$m for easy gripping of the chip surface and transferring slurry. However, after a few polishing operations, the rough polishing pad surface may be planarized leading to a lost in the capacity for gripping, slurry transport and pressure. Consequently, the rate of polishing is likely to drop. At the same time, some of the holes in the polishing pad may be clogged by polishing material (such as particles in the slurry or materials removed from the silicon wafer). Hence, the polishing rate is difficult to maintain. Under such circumstances, the conditioner 17 is needed to re-condition the polishing pad surface so that clogged holes are cleared and the rough surface re-constituted. Conditioning can be carried out after wafer polishing or in tandem with the wafer polishing operation.

Polishing pads can be divided into two major types including a hard polishing pad and a soft polishing pad depending on applications. To condition the hard polishing pad, a diamond conditioner and a nylon conditioner are both required because the hard polishing pad is very hard. Together with de-ionized water from the conditioning pipeline, the diamond conditioner is able to reconstitute the roughened surface of a polishing pad necessary for polishing. Together with de-ionized water or chemical agents delivered by the conditioning pipeline, the nylon conditioner is able to clear away clogging material or leftover diamond particles inside the holes of a polishing pad. In contrast, only a nylon conditioner is needed when conditioning the soft polishing pad.

A conventional chemical-mechanical polishing station can accommodate just one operating conditioner at any one time. Since the conditioner needs to be exchanged when conditioning a hard polishing pad, servicing time is likely to increase, leading to in a longer manufacturing cycle. One method of reducing conditioning time for a hard polishing pad is to set up two working conditioners on the polishing station at the same time. FIG. 2 is a sketch showing a conventional chemical-mechanical polishing station having two conditioners. However, using an additional working conditioner on the polishing pad congests the polishing table and may lead to difficulties in synchronizing some operations. In addition, although the conditioning pipeline in a conventional chemical-mechanical polishing station can deliver de-ionized water or chemical agents, the de-ionized water or chemical agents do not include any ultrasonic or megasonic vibrations. Therefore, the full capacity of de-ionized water or chemical agents in conditioning a polishing pad is not utilized.

SUMMARY OF THE INVENTION

Accordingly, one object of the present invention is to provide a multi-function conditioner set for a chemical-mechanical polishing station. The multi-function conditioner set includes a plurality of conditioner heads each made from a different material so that the processing cycle is shortened and area occupation of the station is reduced. The supply of chemical agents and de-ionized water with ultrasonic or megasonic vibration increases their conditioning capacity to full power. By combining different conditioning heads individually or a plurality of different conditioning heads as groups and using the chemical agents or de-ionized water with ultrasonic or megasonic vibration, a used polishing pad can be re-conditioned and cleaned without causing any conventional technical problems.

To achieve these and other advantages and in accordance with the purpose of the invention, as embodied and broadly described herein, the invention provides a multi-functional conditioner set. The multi-functional conditioner set includes a plurality of conditioning heads and an ejection tube having a vibrator thereon. Materials constituting the conditioning heads differ according to the applications such as roughening, removing polishing material or cleaning (including removing residual diamond dust on the polishing pad). Conditioning heads can be made from materials including diamond particles or nylon. Size and shape of the conditioning heads also depend on application. All the conditioning heads can have identical size or shape or different sizes and shapes. The conditioning beads may be, for example, round, oval linear or cruciform in shape. To operate the multi-functional conditioning heads, pneumatic valve system or a motor is used to activate different combination of heads in each conditioning session according to the type of conditioning required. The ejection tube for delivering chemical agents or de-ionized water is connected to a vibrator. The vibrator is able to induce molecular vibration in the chemical agents or de-ionized water so that sufficient energy is imparted upon the chemical agents or de-ionized water to dislodge polished particle from the polishing pad. In this invention, different results are therefore obtained by using different combinations of conditioning heads and different vibration settings of the vibrator attached to the ejection tube.

The multi-functional conditioner set of this invention group combines together a plurality of conditioning heads with an ejection tube. By combining different single conditioning heads or a plurality of conditioning heads and adjusting the ejection tube settings in different conditioning sessions, conditioning and cleaning of a polishing pad and removal therefrom of residual diamond particles can be conducted sequentially without switching conditioners.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
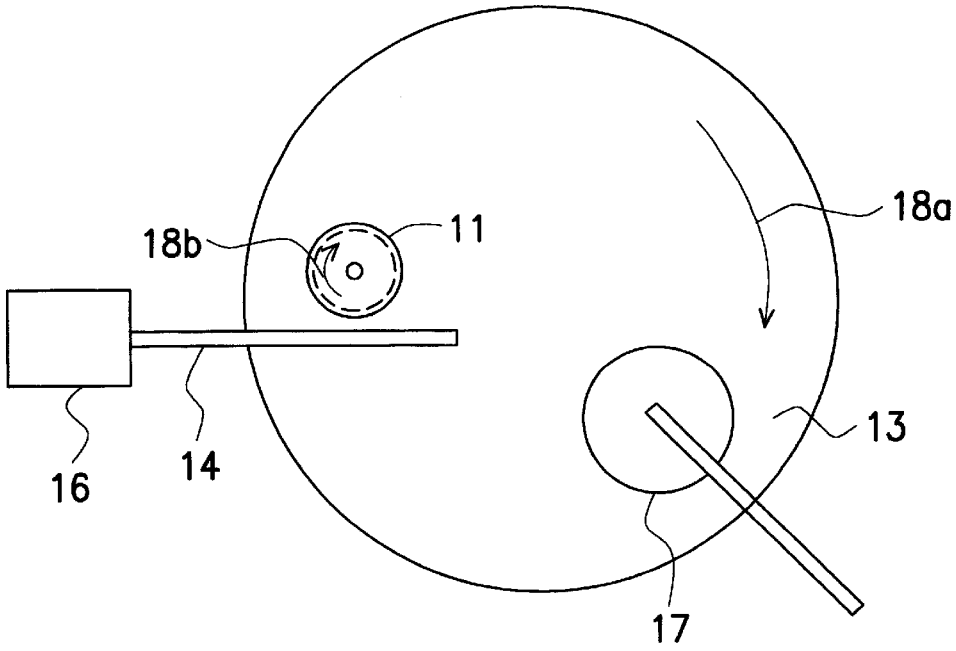
FIG. 1A(PRIOR ART)
FIG. 1A is a top view of a conventional chemical-polishing station.
Figure 1B:
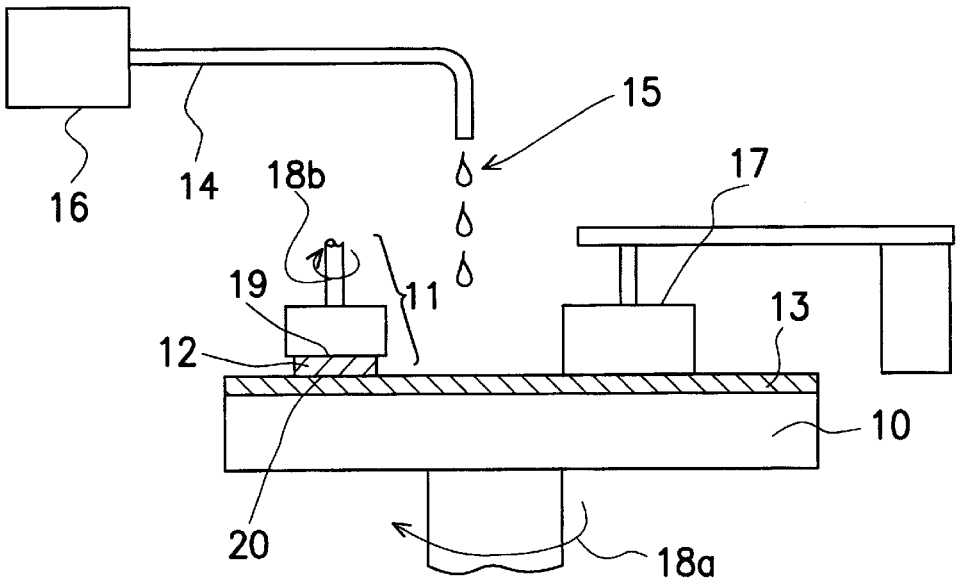
FIG. 1B(PRIOR ART)
FIG. 1B is a side view of a conventional chemical-mechanical polishing station.
Figure 2:
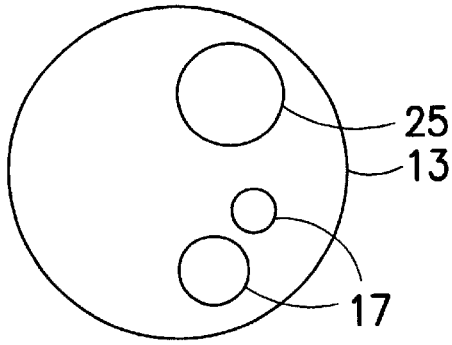
FIG. 2 (PRIOR ART)
FIG. 2 is a sketch showing a conventional chemical-mechanical polishing station having two conditioners.
Figure 3:
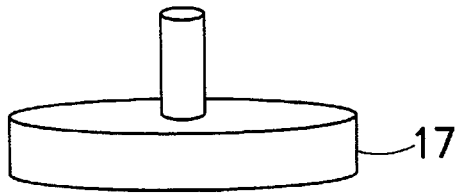
FIG. 3 (PRIOR ART)
FIG. 3 is a side view of a conventional conditioning head.

Reference will now be made in detail to the present preferred embodiments of the invention, examples of which are illustrated in the accompanying drawings. Wherever possible, the same reference numbers are used in the drawings and the description to refer to the same or like parts.

Figure 4:
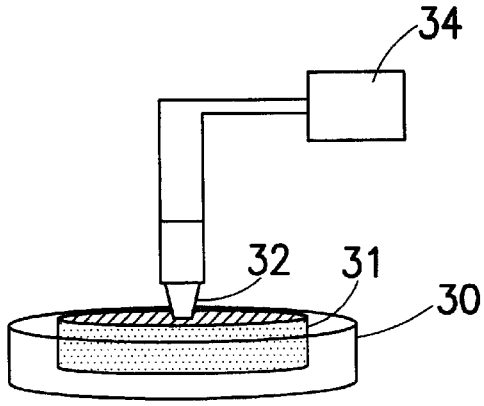
FIG. 4 is a side view showing two concentric circular conditioning heads of a conditioner set according to this invention.

FIG. 4 is a side view showing two concentric circular conditioning heads of a conditioner set according to this invention.

The multi-function conditioner set for a chemical-mechanical polishing station includes a plurality of conditioning heads, each made from a different material. The conditioner set shown in FIG. 4 has two conditioning heads 30 and 31. An ejection tube 32 is also installed above the multi-function conditioner set. Besides providing a chemical agent and de-ionized water, ejection tube 32 is also connected to a vibrator 34. Vibrator 34 induces the molecules inside the chemical agents and de-ionized water into ultrasonic or megasonic vibration. Ejection tube 32 can be positioned at the center of the conditioner set or right at the periphery thereof. In FIG. 4, ejection tube 32 is positioned at the center of the conditioner set.

Figures 5A, 5B, 5C:
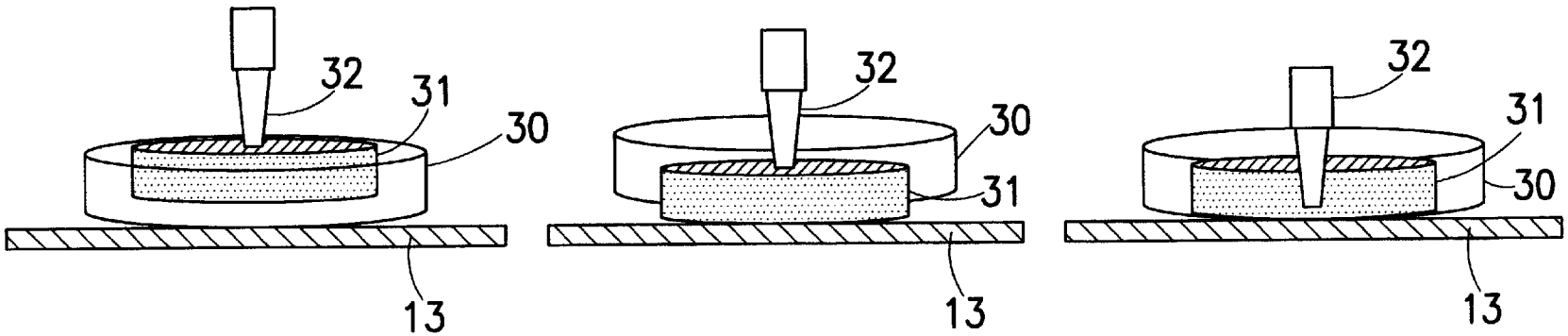
FIGS. 5A through 5C show three possible operating modes of the conditioner set in the form of two concentric circular conditioning heads according to this invention.

FIGS. 5A through 5C show three possible operating modes of the conditioner set in the form of two concentric circular conditioning heads according to this invention. The conditioner set of this invention uses pneumatic valves or a motor (not shown in the figure) to control the movement of conditioning heads 30 and 31 as well as the position and pressure of ejection tube 32. Moreover, the conditioning heads 30 and 31 can be arranged to form various combinations on demand. In FIG. 5A, conditioning head 30 is used to condition a polishing pad 13. In FIG. 5B, conditioning head 31 is used to condition polishing pad 13. In FIG. 5C, both conditioning heads 30 and 31 are used to condition polishing pad 13. In FIGS. 5A, 5B and 5C, ejection tube 32 can provide chemical agents or de-ionized water with or without ultrasonic or megasonic vibration added depending on actual applications.

Figure 6A:
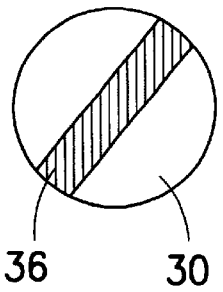
FIGS. 6A through 6F are bottom views showing six possible shapes and arrangements of the conditioning heads according to the conditioner set of this invention.
Figure 6B:
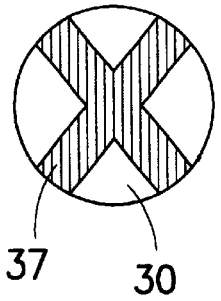
Figure 6C:
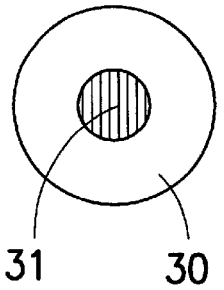
Figure 6D:
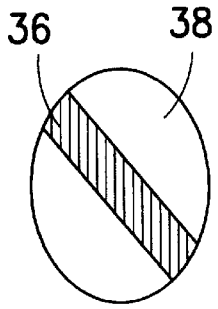
Figure 6E:
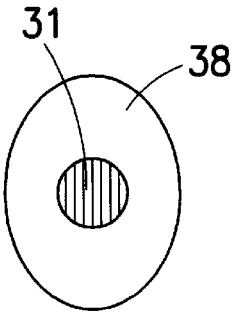
Figure 6F:
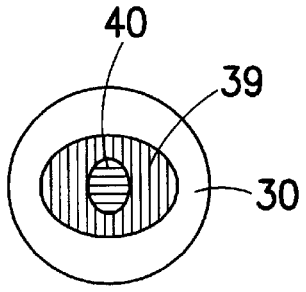

FIGS. 6A through 6F are bottom views showing six possible shapes and arrangements of the conditioning heads according to the conditioner set of this invention. Conditioning heads can be made from different materials. Furthermore, the conditioning heads can have different arrangements with all conditioning heads having identical size and shape or different sizes and shapes. In FIG. 6A, the conditioning head assembly comprises a circular head 30 and a linear head 36. In FIG. 6B, the conditioning head assembly comprises a circular head 30 and a cruciform head 37. In FIG. 6C, the conditioning head assembly comprises two circular heads 30 and 31. In FIG. 6D, the conditioning head assembly comprises an oval head 38 and a linear head 36. In FIG. 6E, the conditioning head assembly comprises an oval head 38 and a circular head 31. In FIG. 6F, the conditioning head assembly comprises a circular head 30 and two oval heads 39 and 40.

After a silicon chip is polished by a hard polishing pad, the hard polishing pad may require reconditioning. The conditioner set shown in FIG. 4 can be used for reconditioning the hard polishing pad. Conditioning head 30 can be a diamond brush while conditioning head 31 can be a nylon brush. Ejection tube 31 delivers necessary chemical agent and de-ionized water for the reconditioning. Since ejection tube 31 is also connected to a vibrator, ultrasonic or megasonic vibration can be imparted upon the chemical agents and de-ionized water. A series of four pad conditioning steps can be carried out using a multi-function conditioner set similar to the one shown in FIG. 4. The first step is shown in FIG. 5A. Diamond brush conditioning head 30 is driven to act on polishing pad 13 and de-ionized water is delivered to conditioning head 30 from ejection tube 32 so that the surface of polishing pad 13 is roughened. The second step is shown in FIG. 5B. Nylon brush conditioning head 31 is driven to act on polishing pad 13 while chemical agents are delivered to conditioning head 31 from ejection tube 32 so that polishing materials and residual diamond dust are removed from polishing pad 13. The third step is also shown in FIG. 5B. Nylon brush conditioning head 31 is driven to act on polishing pad 13 while de-ionized water with megasonic vibration are delivered to conditioning head 31 from ejection tube 32 so that more polishing materials and residual diamond dust are removed. The fourth step is also shown in FIG. 5B. Nylon brush conditioning head 31 is driven to act on polishing pad 13 while de-ionized water is delivered to conditioning head 31 from ejection tube 32 so that polishing pad 13 is further cleaned.

The aforementioned conditioner set of this invention can be used to condition a hard polishing pad while the hard polishing pad is being used for polishing a silicon chip. The conditioner set can also be used to condition a soft polishing pad while the soft polishing pad is being used for polishing or thereafter. In addition, the system provided can also be used simply for cleaning a polishing pad.

In summary, this invention integrates a plurality of conditioning heads into a conditioner set. In addition, a vibration is attached to an ejection tube so that chemical agents and de-ionized water having ultrasonic or megasonic vibration are delivered to the conditioning heads. Therefore, the invention is multi-functional and capable of controlling rotating speed and pressure of each or a group of conditioning heads in every steps of the reconditioning operation. Moreover, ultrasonic or megasonic vibrations can be imparted to the chemical agents and de-ionized water to make full use of the liquids, thereby speeding up the cleaning operation. Hence, processing time is saved, area occupation of conditioning heads is reduced and residual polished material and diamond dust are removed from the polishing pad at a much faster rate.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A conditioner set for performing a conditioning operation on a polishing pad within a chemical-mechanical polishing station, comprising:

a first conditioning head; each said conditioning head having a conditioning face for performing a conditioning operation; and at least a second conditioning head integrated within said first conditioning head in such a manner that both the first conditioning head and at least the second conditioning head face the polishing pad to achieve a conditioning operation.

2. The conditioner set of claim 1, wherein material forming said first conditioning head includes diamond dust and material forming said second conditioning head includes nylon.

3. The conditioner set of claim 1, wherein said first conditioning head and said second conditioning head have concentric circular shapes.

4. The conditioner set of claim 1, wherein said conditioner set further includes an ejection tube that delivers a liquid to said first conditioning head and said second conditioning head.

5. The conditioner set of claim 4, wherein said liquid supplied by said ejection tube includes chemical agents and de-ionized water.

6. The conditioner set of claim 4, wherein said ejection tube is attached to a vibrator that transmits an ultrasonic or megasonic vibration to said liquid.

7. The conditioner set of claim 4, wherein said ejection tube is positioned either at a center of said conditioner set or near a periphery thereof.

8. The conditioner set of claim 1, wherein the conditioning operation is performed individually by each of the first and second conditioning heads.

9. The conditioner set of claim 1, wherein the conditioning operation is performed simultaneously by the first and second conditioning heads.

10. The conditioner set of claim 1, wherein the shape of the first and second conditioning heads are respectively circular and linear, circular and cruciform circular and circular, oval and linear, or oval and circular.

* * * * *